US006786734B2

(12) United States Patent
Yu

(10) Patent No.: US 6,786,734 B2
(45) Date of Patent: Sep. 7, 2004

(54) ELECTRICAL ADAPTER WITH A FOLDABLE HOUSING CROSS-REFERENCE TO RELATED APPLICATION

(75) Inventor: Chun-Chain Yu, Taipei Hsien (TW)

(73) Assignee: Wistron Neweb Corporation, Hsichih Taipei Hsien (TW)

( * ) Notice: Subject to any disclaimer, the term of this patent is extended or adjusted under 35 U.S.C. 154(b) by 36 days.

(21) Appl. No.: 10/394,454

(22) Filed: Mar. 20, 2003

(65) Prior Publication Data

US 2004/0048494 A1 Mar. 11, 2004

(30) Foreign Application Priority Data

Sep. 10, 2002 (TW) ..... 91214214

(51) Int. Cl.[7] ..... H01R 39/00
(52) U.S. Cl. ..... 439/11; 439/31; 439/640
(58) Field of Search ..... 439/11, 13, 31, 439/638, 640

(56) References Cited

U.S. PATENT DOCUMENTS 5,658,152 A * 8/1997 Selker ..... 439/31
6,213,782 B1 * 4/2001 Derstine ..... 439/31

FOREIGN PATENT DOCUMENTS

TW 490100 1/2002

* cited by examiner

*Primary Examiner*—Tho D. Ta
(74) *Attorney, Agent, or Firm*—Merchant & Gould, P.C.

(57) ABSTRACT

An electrical adapter includes a first electrical connector unit, and a second electrical connector unit coupled electrically to the first electrical connector unit. A foldable housing includes first and second housing parts. The first electrical connector unit is mounted in the first housing part, whereas the second electrical connector unit is mounted in the second housing part. The foldable housing further includes a pivot joint that interconnects the first and second housing parts and that permits relative rotation between the first and second housing parts about a pivot axis.

8 Claims, 5 Drawing Sheets

ELECTRICAL ADAPTER WITH A FOLDABLE HOUSING CROSS-REFERENCE TO RELATED APPLICATION

CROSS-REFERENCE TO RELATED APPLICATION

This application claims priority of Taiwanese application no. 091214214, filed on Sep. 10, 2002.

BACKGROUND OF THE INVENTION

1. Field of the Invention

The invention relates to an electrical adapter, such as one that is used to interconnect electrically two different types of electrical connectors, more particularly to an electrical connector with a foldable housing.

2. Description of the Related Art

Most electrical equipments, such as desktop computers, notebook computers, mobile phones, Personal Digital Assistants (PDA), etc., available in the market are equipped with Universal Serial Bus (USB) connectors for connecting to computer peripherals. Referring to FIG. 1, a set of USB connector ports 211 is mounted on the rear panel of a notebook computer 21. The USB connector port 211 of the notebook computer 21 is connected to a computer peripheral, e.g., an external CD-ROM drive 22.

The CD-ROM drive 22 has a signal cable 11. A conventional USB connector 12 is fixed and electrically connected to one end of the signal cable 11 and is coupled electrically to the USB connector port 211 of the notebook computer 21. Since the USB connector 12 typically includes a rigid housing, the USB connector 12 protrudes by a substantial distance from the rear panel of the notebook computer 21 once the USB connector 12 is mounted on the USB connector port 211. The protruding distance as such increases an effective width of the notebook computer 21 from W1 to W2 such that extra space is required on a table when the USB connector 12 is mounted on the USB connector port 211 of the notebook computer 21. The protruding distance also prevents the signal cable 11 from being placed close to the rear panel of the notebook computer 21, thereby making the surrounding area of the notebook computer 21 unsightly.

In addition, the current trend is to equip notebook computers 21 with several USB connector ports 211. In most notebook computers, the USB connector ports 211 are arranged in close proximity. Hence, when each of these ports 211 is connected to the USB connector 12 of a respective computer peripheral, the housings of the USB connectors 12 may be in physical contact with each other. It is thus possible for the USB connector 12 to block other USB connector ports 211 on the rear panel of the notebook computer 21. As such, it is inconvenient to insert another USB connector 12 into an available USB connector port 211. Further, since the USB connectors 12 cannot be reoriented, signal interference among the connectors 12 is likely to occur.

SUMMARY OF THE INVENTION

Therefore, the main object of the present invention is to provide an electrical adapter with a foldable housing that can overcome the aforesaid drawbacks of the prior art.

According to the present invention, an electrical adapter comprises:

a first electrical connector unit;

a second electrical connector unit coupled electrically to the first electrical connector unit; and a foldable housing including first and second housing parts, the first electrical connector unit being mounted in the first housing part, the second electrical connector unit being mounted in the second housing part, the foldable housing further including a pivot joint that interconnects the first and second housing parts and that permits relative rotation between the first and second housing parts about a pivot axis.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

Figure 1:
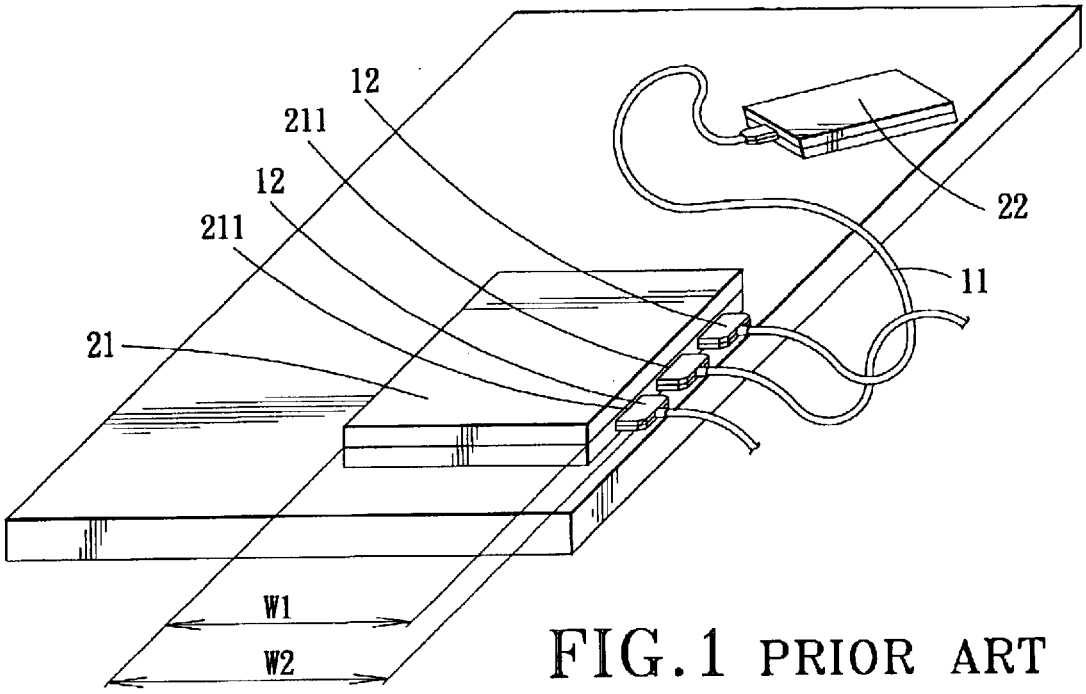
FIG.1 PRIOR ART
FIG. 1 illustrates a conventional USB connector in a state of use.
Figure 2:
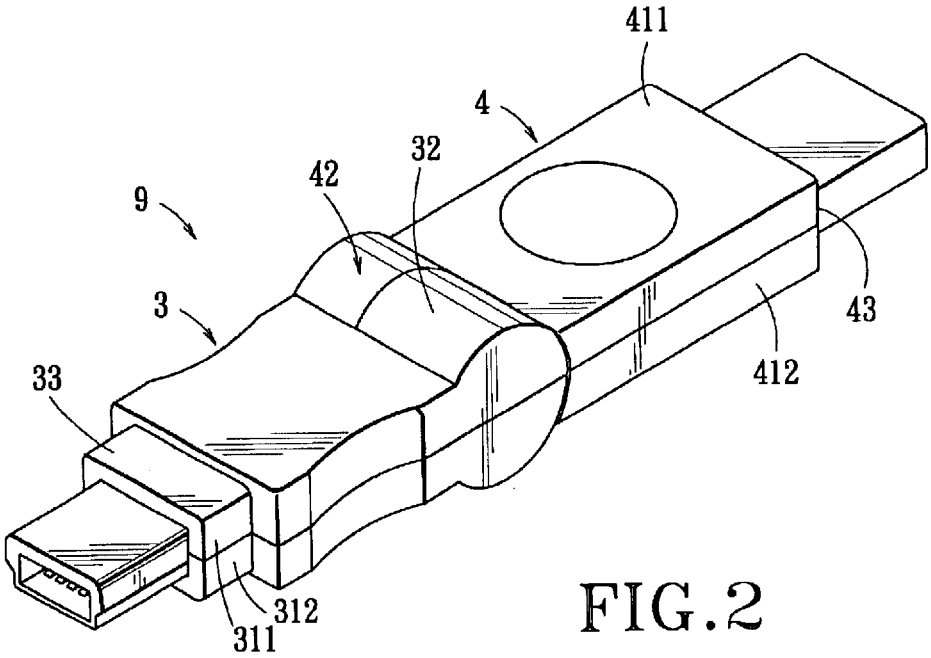
FIG. 2 is a perspective view of the preferred embodiment of an electrical adapter according to this invention.
Figure 3:
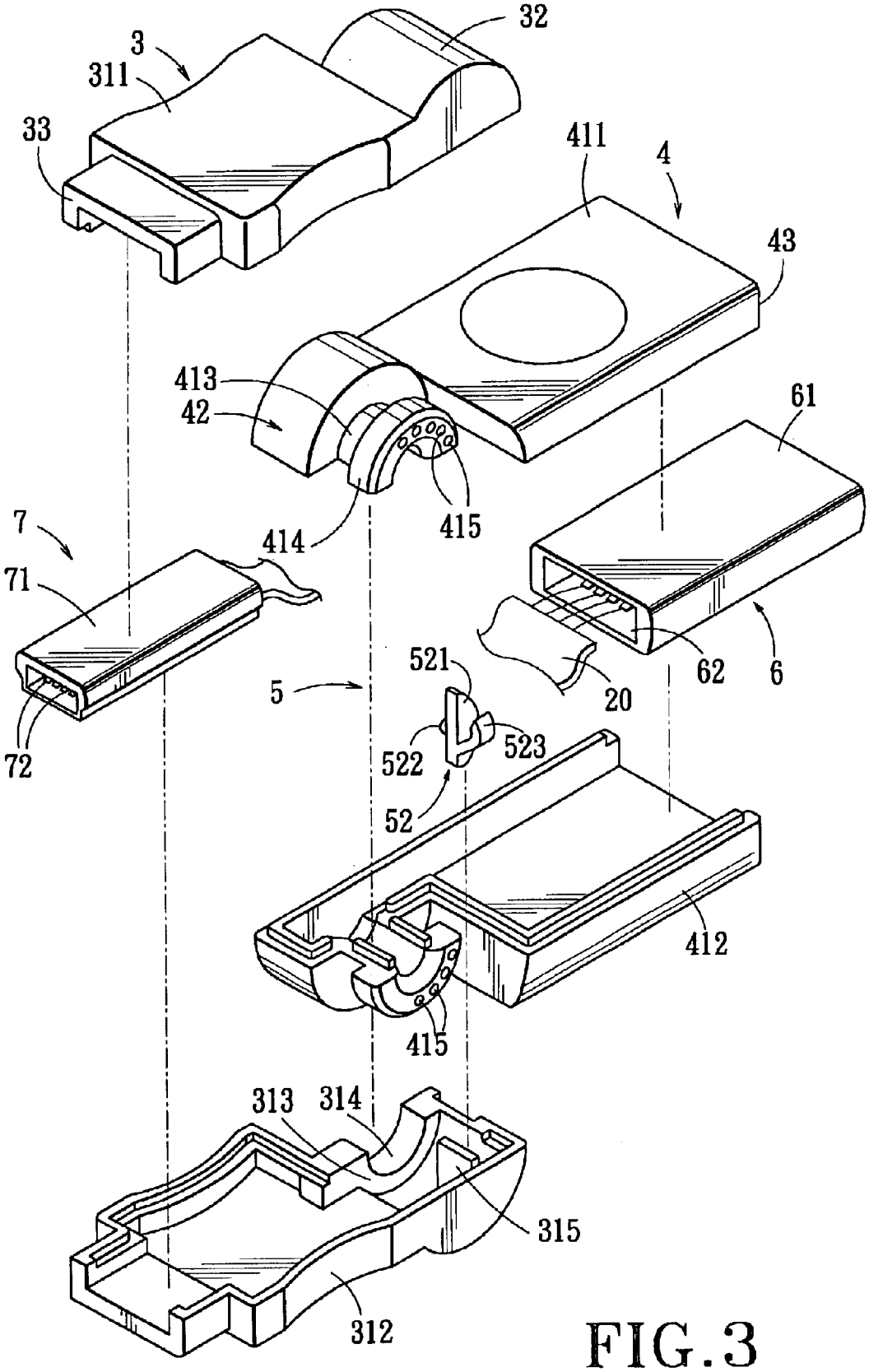
FIG. 3 is an exploded perspective view of the preferred embodiment.

Referring to FIGS. 2 and 3, the preferred embodiment of an electrical adapter 9 according to this invention is shown to include a first electrical connector unit 7, a second electrical connector unit 6, and a foldable housing.

Each of the first and second electrical connectors 7, 6 includes a terminal holding member 71, 61 made of dielectric material, and a terminal set 72, 62 that is mounted in the terminal holding member 71, 61.

A flexible conductive unit 20 has opposite end portions connected electrically and respectively to the terminal sets 72, 62 of the first and second electrical connector units 7, 6.

At least one of the first and second connector units 7, 6 complies with the USB standard. Preferably, both connector units 7, 6 can be a male or female A- or B-type USB connector. In one embodiment, one of the connector units 7, 6 is a male A-type USB connector, the other being a female A-type USB connector. In another embodiment, one of the connector units 7, 6 is a female A-type USB connector, the other being a male B-type USB connector. In yet another embodiment, one of the connector units 7, 6 is a male A-type USB connector, the other one being a female B-type USB connector. In a further embodiment, one of the connector units 7, 6 is a female A-type USB connector, the other being a male B-type USB connector. As such, the first and second connector units 7, 6 can be coupled electrically to USB connector ports of different electrical equipments.

The foldable housing includes a first housing part 4 and a second housing part 3. The first housing part 4 includes a first connector mounting portion 43 for receiving and mounting the first connector unit 7, and a first coupling portion 42 that extends from the first connector mounting portion 43. Similarly, the second housing part 3 includes a second connector mounting portion 33 for receiving and mounting the second connector unit 6, and a second coupling portion 32 that extends from the second connector mounting portion 33. The foldable housing further includes a pivot joint 5 that interconnects the first coupling portion 42 of the first housing part 4 and the second coupling portion 32 of the second housing part 3 and that permits relative rotation between the first and second housing parts 4, 3 about a pivot axis.

Preferably, each of the first and second housing parts 4, 3 includes complementary upper and lower housing halves 411, 412, 311, 312.

The pivot joint 5 includes a tubular pivot shaft 413 formed on the first coupling portion 42, a hole-defining wall 313 formed on the second coupling portion 32, and an end flange 414 formed on one end of the pivot shaft 413. The conductive unit 20 further has an intermediate portion (not visible) between the first and second electrical connector units 7, 6 and extending through the pivot shaft 413. The hole-defining wall 313 defines a pivot hole 314 to permit extension of the pivot shaft 413 into the second coupling portion 32. As such, the end flange 414 can be rotatably disposed in the second coupling portion 32. The end flange 414 is generally cylindrical, and is formed with angularly spaced apart positioning grooves 415.

Figure 6:
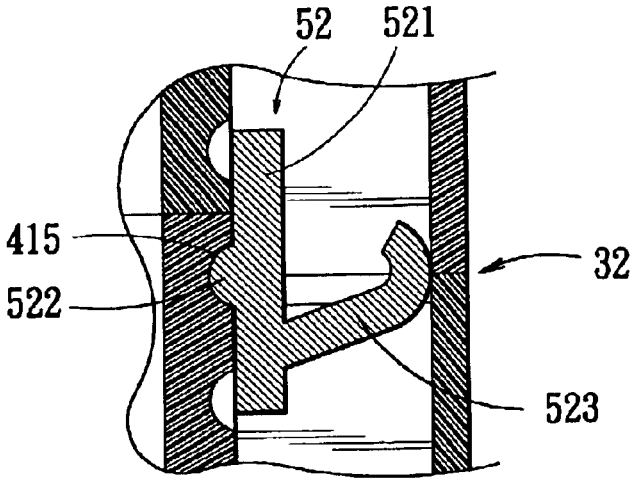
FIGS. 6 and 7 are fragmentary sectional views to illustrate operation of a positioning unit of a pivot joint of the preferred embodiment.
Figure 7:
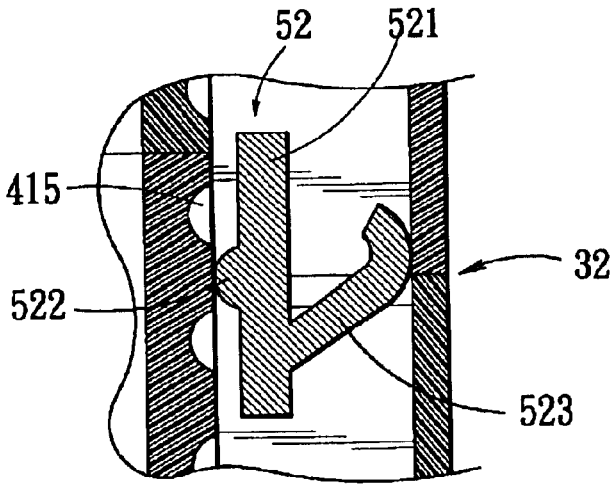

The pivot joint 5 further includes a positioning unit 52 mounted in the second coupling portion 32. The positioning unit 52 includes abase plate 521, an engaging protrusion 522, and a spring arm 523. The base plate 521 is disposed adjacent to the end flange 414, and has a first side that faces the end flange 414 and a second side that is opposite to the first side. The engaging protrusion 522 is formed on the first side of the base plate 521 for releasably engaging an aligned one of the positioning grooves 415 in the end flange 414, as best shown in FIGS. 6 and 7. The spring arm 523 is disposed on the second side of the base plate 521 and biases the base plate 521 toward the end flange 414. The positioning grooves 415 are concave grooves, and the engaging protrusion 522 is a rounded protrusion to facilitate slidable disengagement between the end flange 414 and the positioning unit 52. Preferably, a partition wall 315 is formed in the second coupling portion 32 to hold the positioning unit 52 in place relative to the end flange 414.

When the electrical adapter 9 is in the position shown in FIG. 2, the engaging protrusion 522 of the positioning unit 52 engages securely one of the positioning grooves 415 in the end flange 414 due to the biasing force of the spring arm 523, as best shown in FIG. 6.

Figure 4:
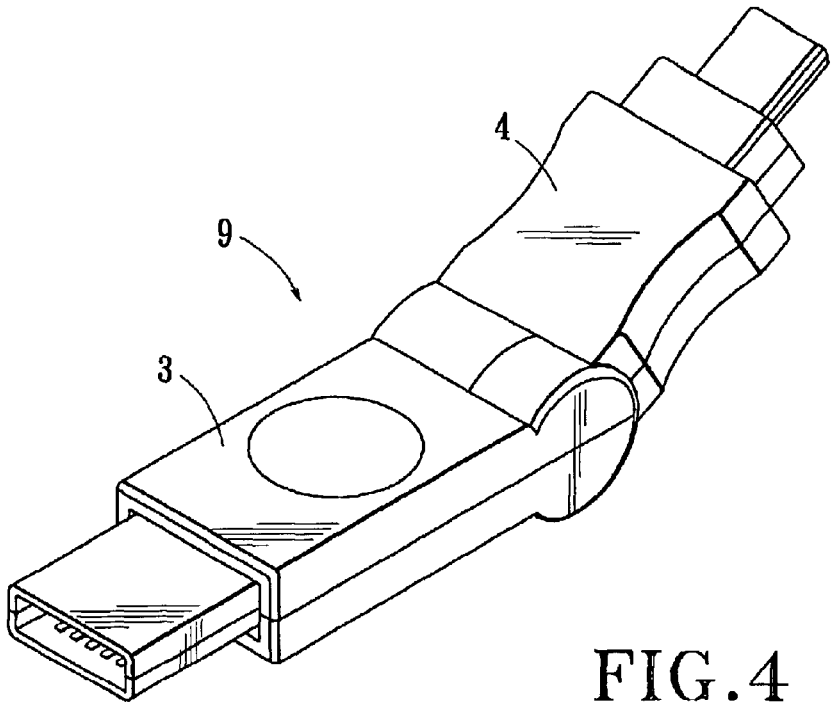
FIG. 4 is a perspective view of the preferred embodiment to illustrate a housing in a first folded state.
Figure 5:
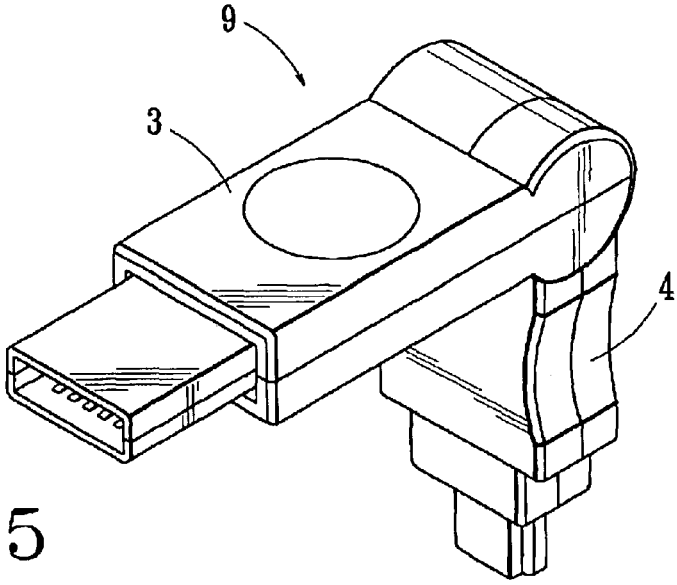
FIG. 5 is a perspective view of the preferred embodiment to illustrate the housing in a second folded state.

When it is desired to adjust the electrical adapter 9 to angular positions shown in FIGS. 4 and 5, the first or the second housing part 4, 3 is simply pivoted upwardly or downwardly relative to the other housing part 4, 3. This pivotal movement, through appropriate manual force, results in relative rotation between the positioning unit 52 and the end flange 414 of the pivot shaft 413, and causes the engaging protrusion 522 of the positioning unit 52 to disengage from the positioning groove 415 in the end flange 414 against the biasing force of the spring arm 523, as best shown in FIG. 7. The spring arm 523 restores the positioning unit 52 to its engaging position when the engaging protrusion 533 of the positioning unit 52 is aligned with another positioning groove 415 in the end flange 414. The first and second housing parts 4, 3 can be rotated about the pivot axis to form different angles therebetween, and can be retained at different angular positions by virtue of the engagement between the engaging protrusion 522 of the positioning unit 52 and the end flange 414.

Figure 8:
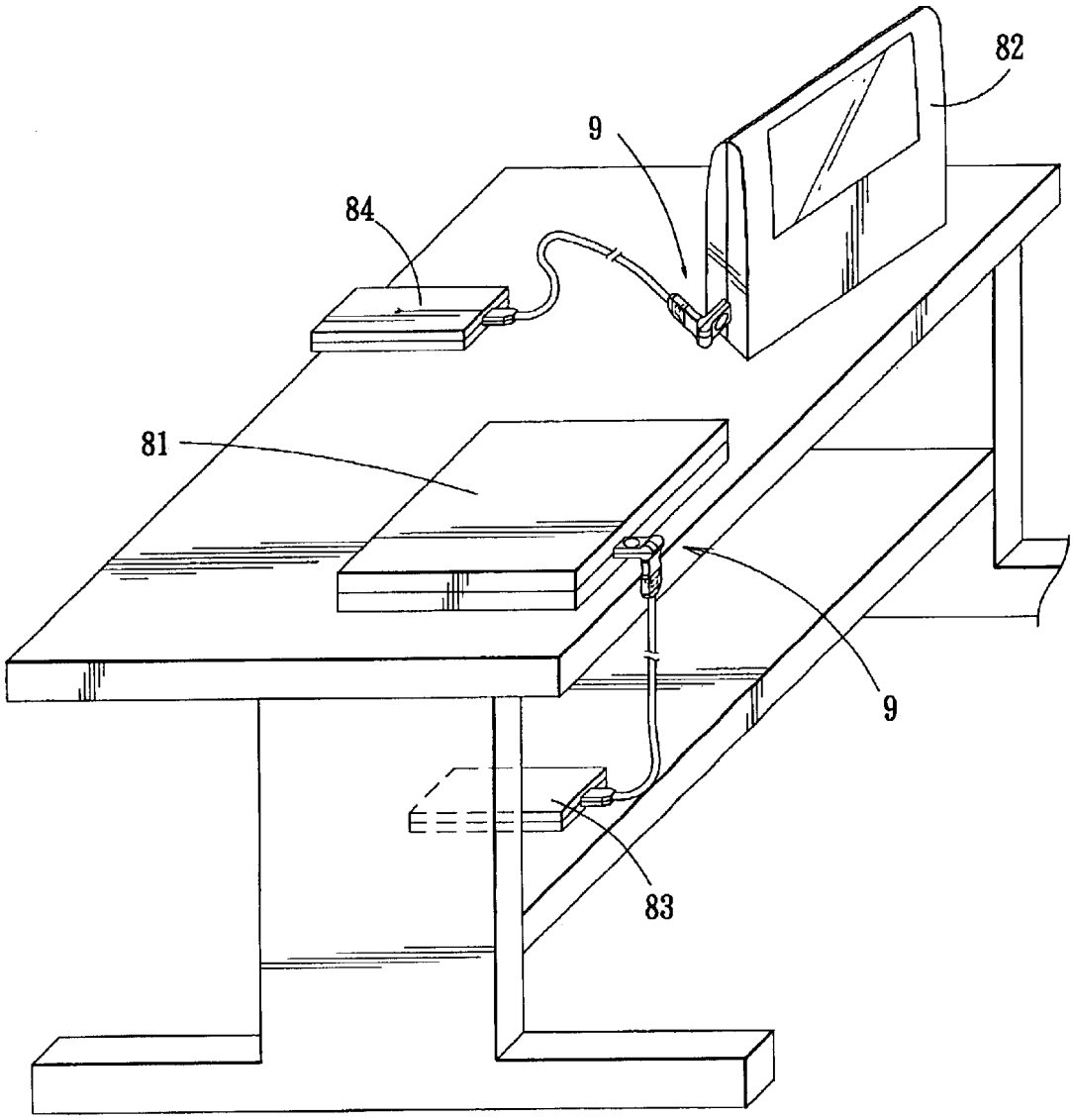
FIG. 8 illustrates the preferred embodiment in a state of use.

Since the first and second housing parts 4, 3 can be rotated to form different angles, as illustrated in FIG. 8, when the electrical adapter 9 is applied to different electrical equipments 81, 82 (e.g., portable computer or upright modem, etc), and is folded in the manner described hereinabove, the electrical equipments 81, 82 can be conveniently positioned such that the first connector unit 7 (or the second connector unit 6) is electrically coupled to the connector port of the electrical equipment 81, 82, and the second connector unit 6 (or the first connector unit 7) is electrically coupled to another electrical equipment 83, 84.

Further, the electrical adapter according to this invention can be connected to a directional antenna. As such, the antenna can be oriented, by rotating the first and second housing parts 4, 3 relative to each other, to properly receive wirelessly transmitted signals.

The electrical adapter 9 of the present invention has the following advantages:

1. The foldable housing of the electrical adapter 9 can be adjusted to different angular positions.

By upwardly or downwardly pivoting either the first or the second housing part 4, 3 of the electrical adapter 9 in the present invention, which causes the engaging protrusion 522 of the positioning unit 52 to engage a selected one of the positioning grooves 415, the first and second housing parts 4, 3 can be rotated to different angles. This allows the signal cable to be oriented and routed in desired directions.

In addition, when an antenna is connected to the electrical adapter 9 of this embodiment, the antenna can be oriented to different directions to ensure proper signal transmission or reception.

2. Less work space is required.

Since the first and second housing parts 4, 3 of the electrical adapter 9 can be relatively rotated to different angles, for practical use, the angle can be adjusted to 90 degrees in order to minimize the space occupied by the electrical adapter 9.

3. Signal interference can be minimized.

Since the electrical adapter 9 of this invention can be adjusted to different angular positions, interference among nearby connectors can be minimized.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An electrical adapter comprising:

a first electrical connector unit;

a second electrical connector unit coupled electrically to said first electrical connector unit;

a foldable housing including first and second housing parts, wherein said first housing part includes a said first electrical connector unit being mounted on a first connector mounting portion for receiving said first electrical connector unit, and a first coupling portion that extends from said first connector mounting portion, wherein said second housing part including said second electrical connector unit being mounted on a second connector mounting portion for receiving said second electrical connector unit, and a second coupling portion that extends from said second connector mounting portion;

said foldable housing further including a pivot joint that interconnects said first and second housing parts and that permits relative rotation between said first and second housing parts about a pivot axis, wherein said pivot joint interconnecting said first and second coupling portions, said pivot joint includes:

a pivot shaft formed on said first coupling portion;

a hole-defining wall formed on said second coupling portion, said hole-defining wall defining a pivot hole to permit extension of said pivot shaft into said second coupling portion; and an end flange formed on one end of said pivot shaft and disposed in said second coupling portion, wherein said end flange is formed with a plurality of angularly spaced apart positioning grooves;

said pivot joint further including a positioning unit mounted in said second coupling portion and releasably engaging said positioning grooves in said end flange.

2. The electrical adapter as claimed in claim 1, wherein said positioning unit includes:

a base plate disposed adjacent to said end flange and having a first side that faces said end flange, and a second side that is opposite to said first side;

an engaging protrusion formed on said first side of said base plate for engaging an aligned one of said positioning grooves in said end flange; and a spring arm disposed on said second side of said base plate and biasing said base plate toward said end flange.

3. The electrical adapter as claimed in claim 2, wherein said positioning grooves are concave grooves, and said engaging protrusion is a rounded protrusion.

4. An electrical adapter comprising:

a first electrical connector unit;

a second electrical connector unit coupled electrically to said first electrical connector unit;

a foldable housing including first and second housing parts, wherein said first housing part includes a said first electrical connector unit being mounted on a first connector mounting portion for receiving said first electrical connector unit, and a first coupling portion that extends from said first connector mounting portion, wherein said second housing part including said second electrical connector unit being mounted on a second connector mounting portion for receiving said second electrical connector unit, and a second coupling portion that extends from said second connector mounting portion, said foldable housing further including a pivot joint that interconnects said first and second housing parts and that permits relative rotation between said first and second housing parts about a pivot axis, wherein said pivot joint interconnecting said first and second coupling portions, said pivot joint includes:

a pivot shaft formed on said first coupling portion;

a hole-defining wall formed on said second coupling portion, said hole-defining wall defining a pivot hole to permit extension of said pivot shaft into said second coupling portion; and an end flange formed on one end of said pivot shaft and disposed in said second coupling portion, wherein said pivot shaft is tubular, and said electrical adapter further includes a flexible conductive unit disposed in said foldable housing, said conductive unit having opposite end portions connected electrically and respectively to said first and second electrical connector units, said conductive unit further having an intermediate portion between said first and second electrical connector units and extending through said pivot shaft.

5. An electrical adapter comprising:

first and second housing parts, wherein said first housing part includes a first mounting portion mounted with a first terminal set, and a first coupling portion that extends from said first mounting portion, wherein said second housing part including a second mounting portion mounted with a second terminal set, and a second coupling portion that extends from said second mounting portion, said second terminal set is electrically coupled to said first terminal set; and a pivot joint that interconnects said first and second coupling portions of said first and second housing parts and that permits relative rotation between said first and second housing parts about a pivot axis, wherein said pivot joint further includes:

a pivot shaft formed on said first coupling portion;

a hole-defining wall formed on said second coupling portion, said hole-defining wall defining a pivot hole to permit extension of said pivot shaft into said second coupling portion; and an end flange formed on one end of said pivot shaft and disposed in said second coupling portion, wherein said end flange is formed with a plurality of angularly spaced apart positioning grooves;

said pivot joint further including a positioning unit mounted in said second coupling portion and releasably engaging said positioning grooves in said end flange.

6. The electrical adapter as claimed in claim 5, wherein said positioning unit includes:

a base plate disposed adjacent to said end flange and having a first side that faces said end flange, and a second side that is opposite to said first side;

an engaging protrusion formed on said first side of said base plate for engaging an aligned one of said positioning grooves in said end flange; and a spring arm disposed on said second side of said base plate and biasing said base plate toward said end flange.

7. The electrical adapter as claimed in claim 6, wherein said positioning grooves are concave grooves, and said engaging protrusion is a rounded protrusion.

8. An electrical adapter comprising:

first and second housing parts, wherein said first housing part includes a first mounting portion mounted with a first terminal set, and a first coupling portion that extends from said first mounting portion, wherein said second housing part including a second mounting portion mounted with a second terminal set, and a second coupling portion that extends from said second mounting portion, said second terminal set is electrically coupled to said first terminal set; and a pivot joint that interconnects said first and second coupling portions of said first and second housing parts and that permits relative rotation between said first and second housing parts about a pivot axis, wherein said pivot joint further includes:

a pivot shaft formed on said first coupling portion;

a hole-defining wall formed on said second coupling portion, said hole-defining wall defining a pivot hole to permit extension of said pivot shaft into said second coupling portion; and an end flange formed on one end of said pivot shaft and disposed in said second coupling portion, wherein said pivot shaft is tubular, and said electrical adapter further includes a flexible conductive unit having opposite end portions connected electrically and respectively to said first and second terminal sets, said conductive unit further having an intermediate portion between said first and second electrical connector units, said flexible conductive unit being disposed in said first and second housing parts such that said intermediate portion of said conductive unit extends through said pivot shaft.

* * * * *